US011253058B1

(12) United States Patent
Hobbs

(10) Patent No.: US 11,253,058 B1
(45) Date of Patent: Feb. 22, 2022

(54) VERTEBRAE CONFIGURABLE DESK

(71) Applicant: Clint Hobbs, Birmingham, AL (US)

(72) Inventor: Clint Hobbs, Birmingham, AL (US)

( * ) Notice: Subject to any disclaimer, the term of this patent is extended or adjusted under 35 U.S.C. 154(b) by 0 days.

(21) Appl. No.: 15/912,564

(22) Filed: Mar. 5, 2018

Related U.S. Application Data

(60) Provisional application No. 62/467,035, filed on Mar. 3, 2017.

(51) Int. Cl.
*F16M 11/16* (2006.01)
*A47B 13/02* (2006.01)
*A47B 13/10* (2006.01)

(52) U.S. Cl.
CPC ..... *A47B 13/02* (2013.01); *A47B 13/10* (2013.01)

(58) Field of Classification Search
CPC ..... A47B 13/00; A47B 13/10; A47B 13/02; A47B 9/00
See application file for complete search history.

(56) References Cited

U.S. PATENT DOCUMENTS

| | | | | | |
|---|---|---|---|---|---|
| 2,634,183 | A * | 4/1953 | Derman | A47B 1/00 108/90 |
| D175,110 | S * | 7/1955 | Howard | D6/696.3 |
| D554,921 | S * | 11/2007 | Gordon | D6/707.22 |
| 8,776,699 | B2 * | 7/2014 | Nasseri | A47B 13/10 108/64 |
| 9,538,843 | B2 * | 1/2017 | Stubbs | A47B 9/00 |
| D834,865 | S * | 12/2018 | Godwin | D6/707.22 |
| 2015/0028633 | A1 * | 1/2015 | Stubbs | A47B 9/00 297/135 |

* cited by examiner

*Primary Examiner* — Amy J. Sterling
(74) *Attorney, Agent, or Firm* — L. F. Hilbers

(57) ABSTRACT

A table system includes a table surface and legs. The table surface includes a top planar surface and a bottom planar surface. The table surface also includes side surfaces having various curved or linear shapes. The shortest side surface has a substantially linear shape while the other side surfaces are curvilinear. The curved side surfaces each have a radius of curvature substantially the same. The table system also includes connection bars located beneath the table surface that also have substantially the same curved or linear shape as the side surfaces.

12 Claims, 8 Drawing Sheets

VERTEBRAE CONFIGURABLE DESK

FIELD OF THE INVENTION

The present invention relates to a table system having a table surface and mounting plates configured for attaching a plurality of legs.

DISCUSSION OF THE RELATED ART

Conventional tables may buckle under loads or pressure.

SUMMARY OF THE INVENTION

A table system is disclosed. The table system includes a table surface having a top planar surface and a bottom planar surface. A plurality of side surfaces is located between the top planar surface and the bottom planar surface. The table system also includes a plurality of mounting plates and mounting attachments connected to the table surface on the bottom planar surface at a plurality of corners on the table surface. The table system also includes a plurality of legs to insert into the plurality of mounting attachments. The table system also includes a plurality of connection bars coupled to the plurality of mounting attachments. Each of the plurality of connection bars is configured between two of the plurality of mounting attachments. The plurality of side surfaces includes a set of curvilinear shaped side surfaces having at least one curvilinear shaped side surface having a concave arc and at least one curvilinear shaped side surface having a convex arc. The concave arc and the convex arc have a radius of curvature. The plurality of side surfaces also includes a linear shaped side surface that is the shortest side surface of the plurality of side surfaces.

Another table system is disclosed. The table system includes a table surface. The table surface includes a top planar surface. The table surface also includes a bottom planar surface located below the top planar surface. The table surface also includes side surfaces between the top planar surface and the bottom planar surface. The side surfaces comprise at least one side surface having a curvilinear shape with a concave arc, at least one side surface having a curvilinear shape with a convex arc, and a side surface having a substantially linear shape. The substantially linear shaped side surface is shorter in length than the curvilinear shaped side surfaces. The table surface also includes a plurality of corners to connect the side surfaces. The plurality of corner has a rounded shape. The table system also includes mounting plates and mounting attachments connected to the bottom planar surface at each of the plurality of corners. The table system also includes connection bars configured between the mounting attachments and corresponding to the side surfaces. Each of the connection bars having a shape substantially similar to its corresponding side surface. The table system also includes legs configured to be inserted into the mounting attachments. The convex arc and the concave arc of the curvilinear shaped side surfaces have a substantially similar radius of curvature.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Figure 1:
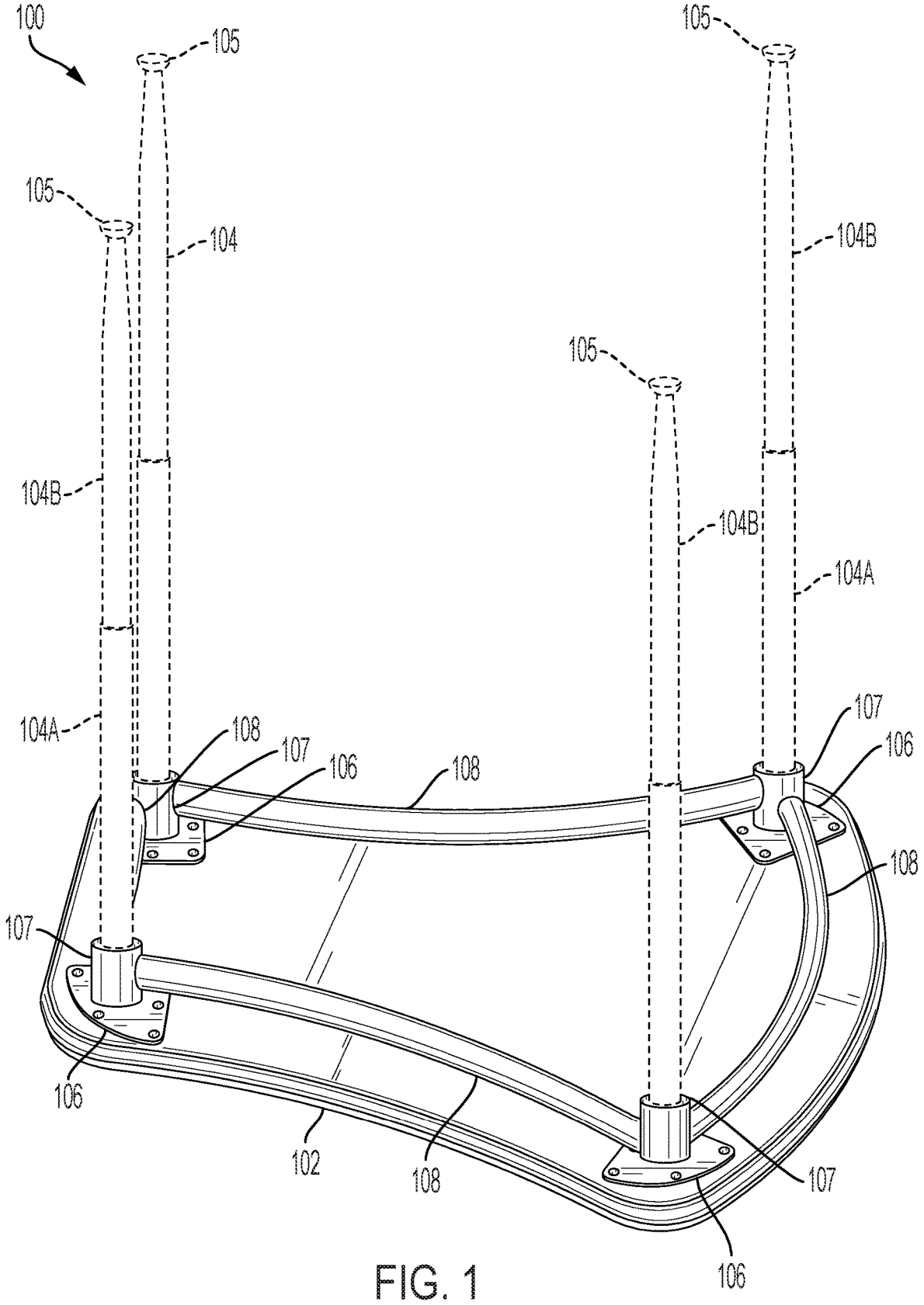
FIG. 1 illustrates a bottom perspective view of a table system according to the disclosed embodiments.
Figure 2:
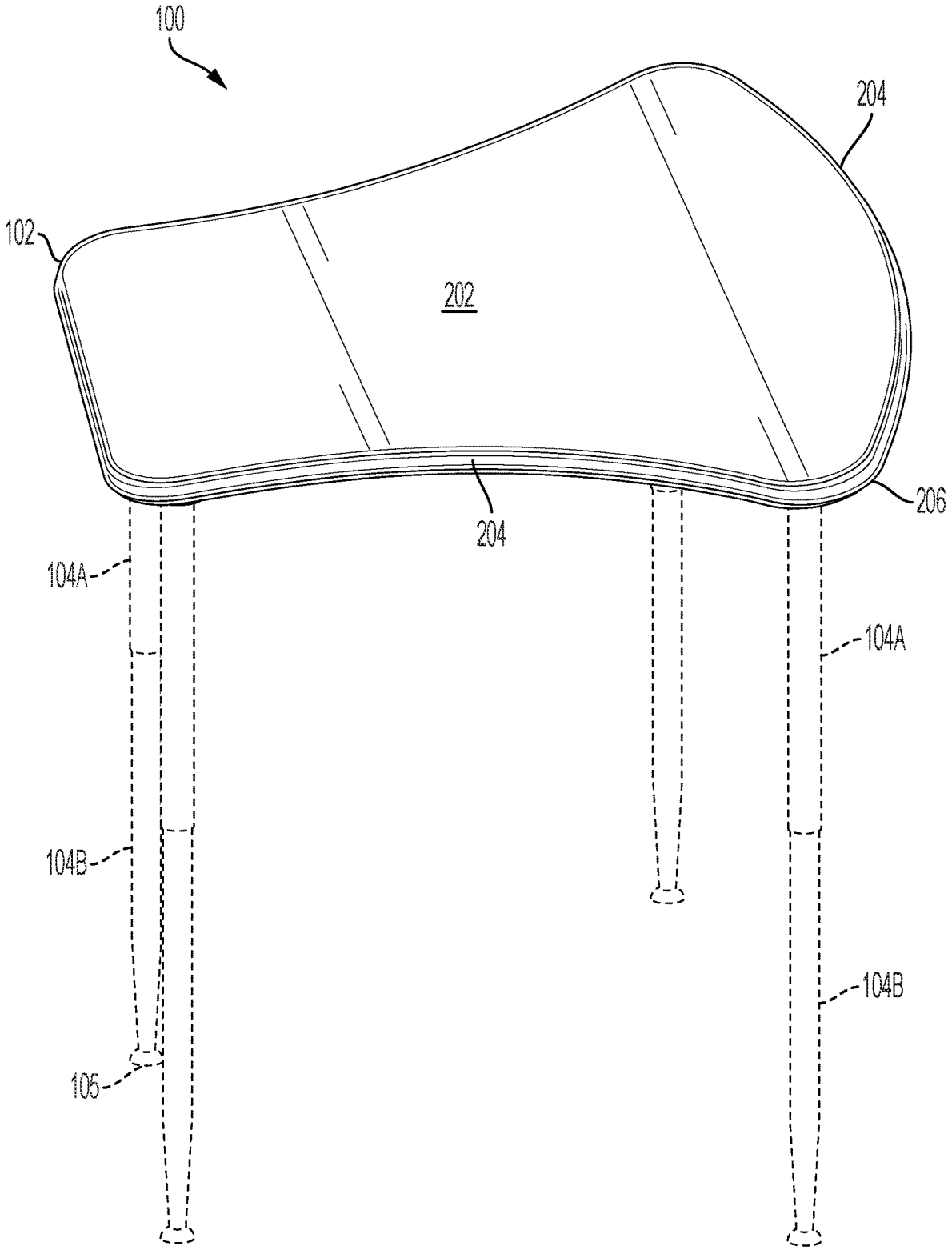
FIG. 2 illustrates a top perspective view of the table system according to the disclosed embodiments.

FIG. 1 depicts a table system 100 according to the disclosed embodiments. Table system 100 is shown from an upside down perspective view in order to see the components of the table below table surface 102. FIG. 2 depicts table system 100 from a top perspective view according to the disclosed embodiments.

Table system 100 include table surface 102. Table surface 102 has a top planar surface and a bottom planar surface, disclosed in greater detail below. The top planar surface is used for activities at the table system or to provide support for items placed on table system 100. The bottom planar surface is used to attach legs 104 with table system 100. Table surface 102 has at least three sides. As shown in the figures, table surface 102 includes four sides. In other embodiments, the number of sides for table surface 102 may include three, five, six, and the like.

Legs 104 provide support for table surface 102. In some embodiments, the number of legs 104 may match the number of sides of table surface 102. More particularly, the number of legs may correspond to the number of corners of table surface 102. Legs 104 may be split into sections that are connected together to provide a height for table surface 102. In some embodiments, the height of legs 104 is adjustable. As shown in the figures, legs 104 include upper leg section 104A and lower leg section 104B. Lower leg section 104B may have a diameter smaller than one for upper leg section 104A such that the lower leg section fits into the upper leg section. Upper leg section 104A and lower leg section 104B may be secured to each other, as disclosed in greater detail below.

Legs 104 may include pads 105. Pads 105 are located at the ends of lower leg sections 104B most distant from table surface 102. Pads 105 may be comprised of soft material to not scratch a surface and to allow some adjustment of the height of table system 100. For example, when one leans against table surface 102 while writing, pads 105 may compress a slight amount to avoid legs 104 from digging into the floor, carpet, ground, and the like. In other embodiments, pads 105 may be made of metallic, or other, material. Pads 105 also prevent movement of table system 100 while in use.

Table system 100 also includes mounting plates 106 and mounting attachments 107. A mounting set of a mounting plate 106 and a mounting attachment 107 may be used for each leg 104 in table system 100. The mounting set may be located at each corner of table surface 102 and serves as an attachment point for a leg 104. Mounting plate 106 secures the mounting set to the bottom planar surface of table surface 102. Mounting attachment 107 receives upper leg section 104A of leg 104. In some embodiments, upper leg section 104A may be removable from mounting attachment 107 so that table system 100 can be broken down. In some embodiments, the mounting set may be comprised of metal, even if table surface 102 and legs 104 are not.

Table system 100 also includes connection bars 108 located between each mounting attachment 107. A connection bar 108 may be fitted into holes within two mounting attachments 107 such that each mounting attachment includes two holes. This is disclosed in greater detail below. Connection bars 108 also may be known as support bars and provide additional support for weight placed on table surface 102.

As noted above, table surface 102 includes two planar surfaces. Referring to FIG. 2, table surface 102 is shown with top planar surface 202, side surfaces 204, and bottom planar surface 206. In some embodiments, bottom planar surface 206 may have a larger surface area that top planar surface 202. In such embodiments, side surfaces 204 have a slope to account for the difference in sizes of planar surfaces 202 and 206. The opposite condition also may be used in that top planar surface 202 has a larger surface area than bottom planar surface 206. Side surfaces 204 of table surface 102 may include a curvilinear shape from some portions and not for others. This feature is disclosed in greater detail below.

Figure 3:
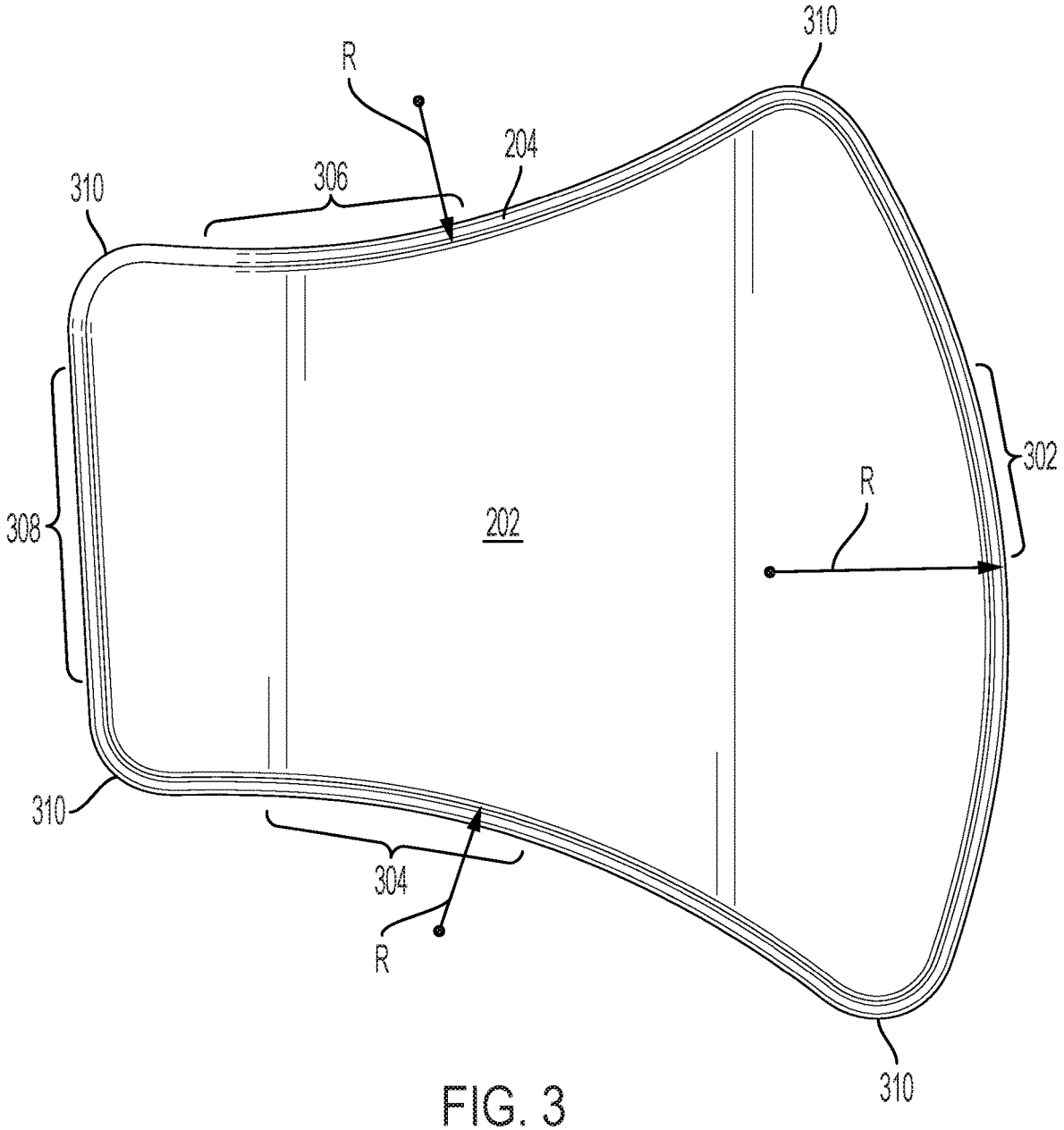
FIG. 3 illustrates a table surface of the table system according to the disclosed embodiments.
Figure 4:
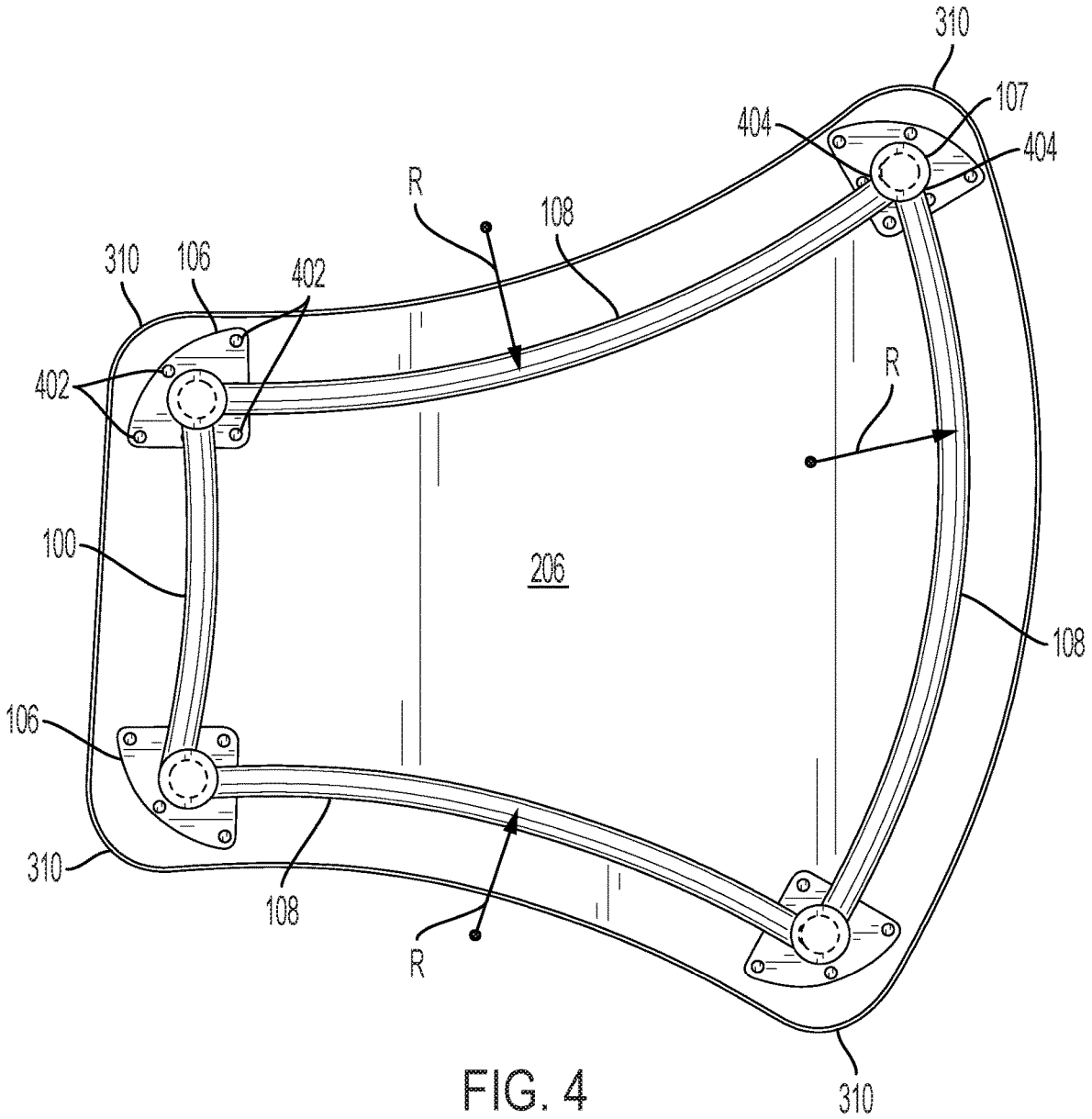
FIG. 4 illustrates a bottom view of the table surface along with attachment points according to the disclosed embodiments.
Figure 5:
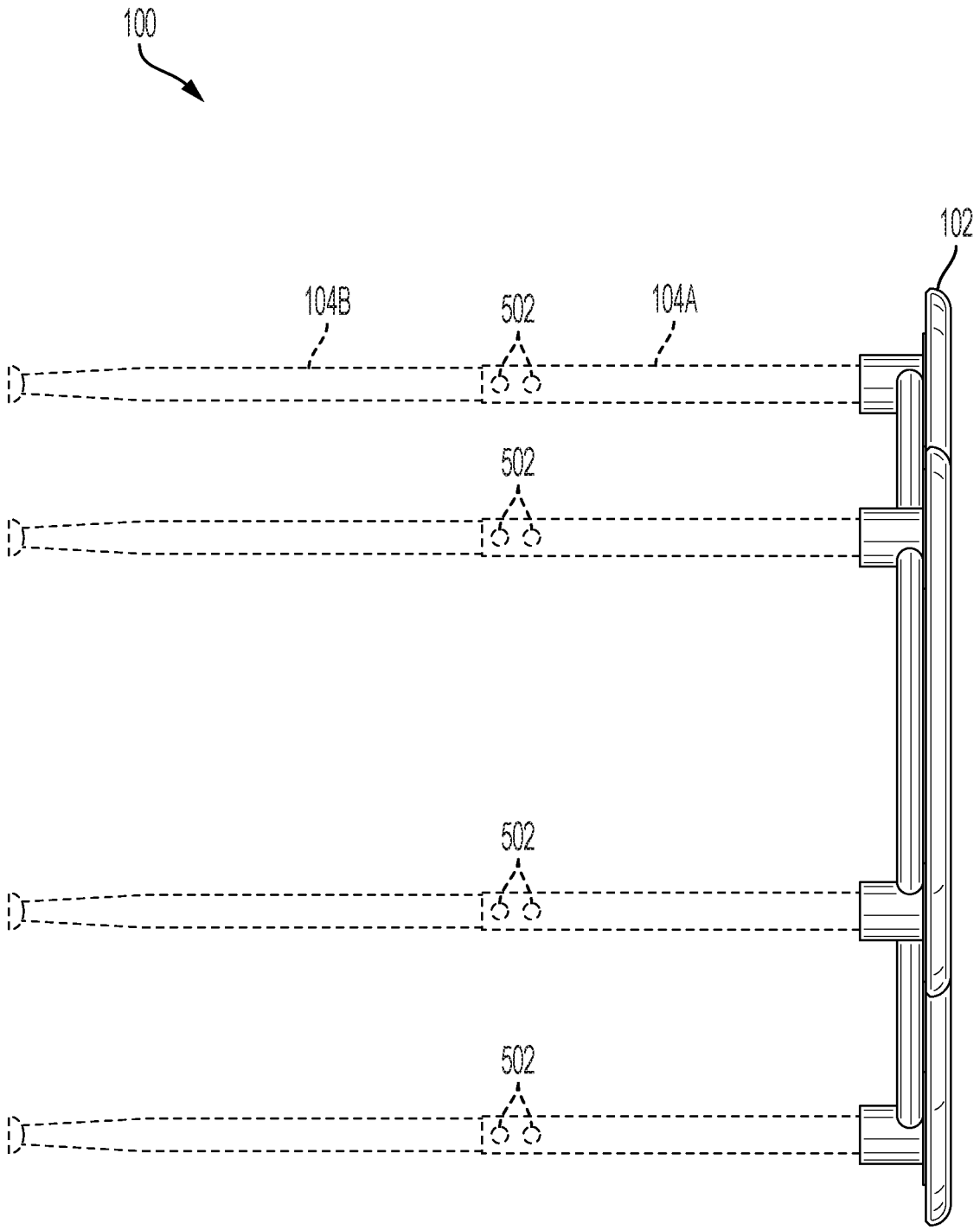
FIG. 5 illustrates a side view of the table system according to the disclosed embodiments.
Figure 6:
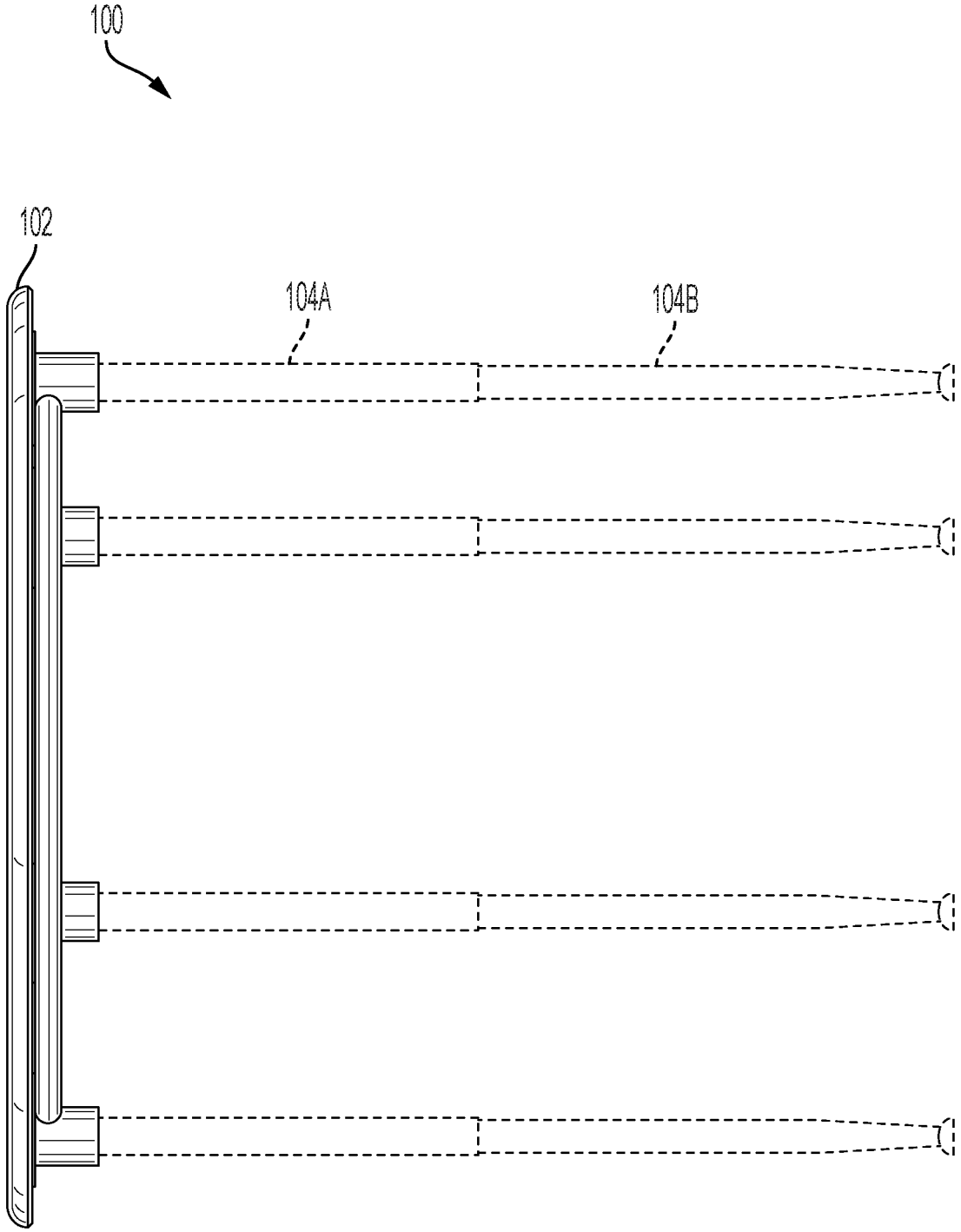
FIG. 6 illustrates another side view of the table system according to the disclosed embodiments.
Figure 7:
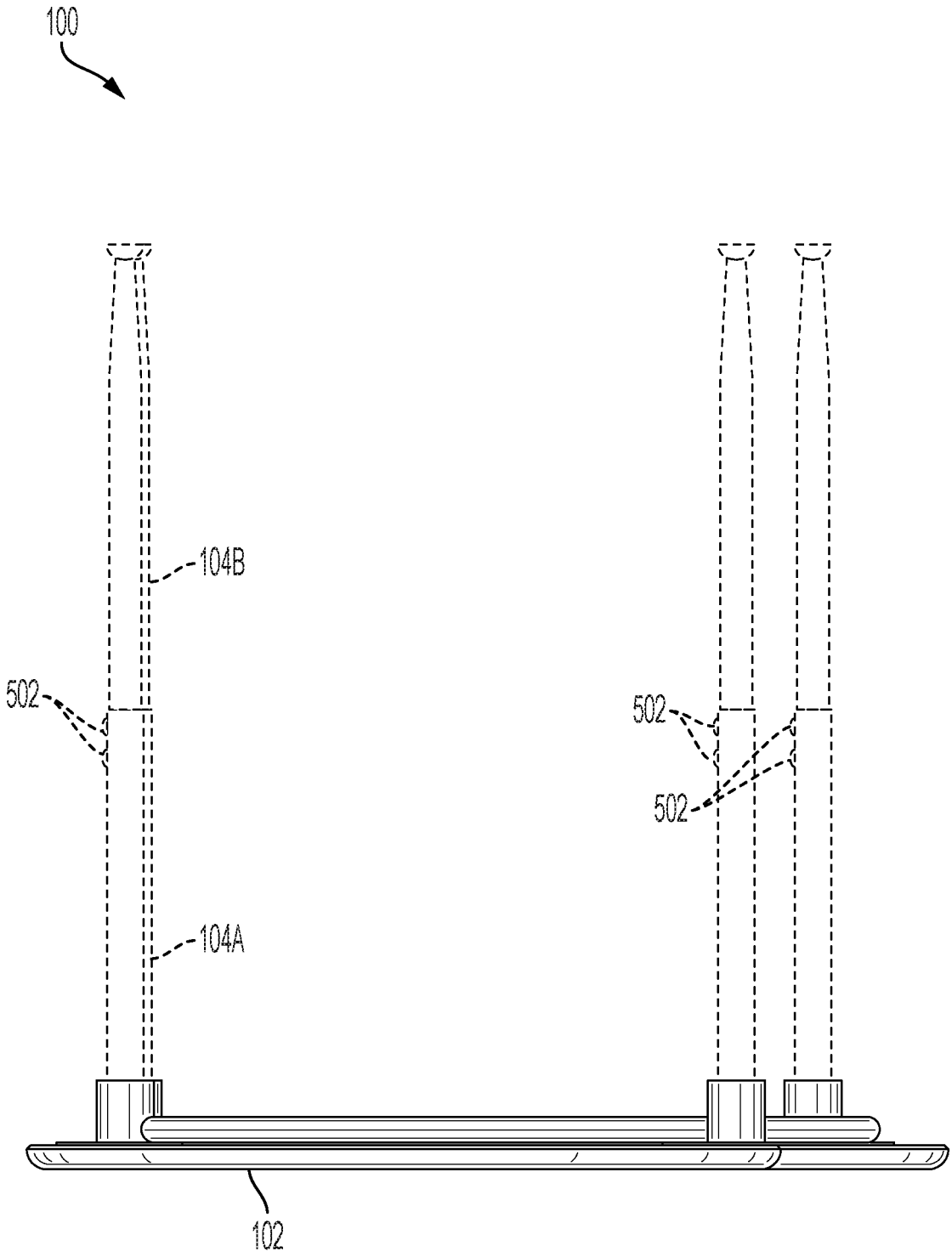
FIG. 7 illustrates another side view of the table system according to the disclosed embodiments.
Figure 8:
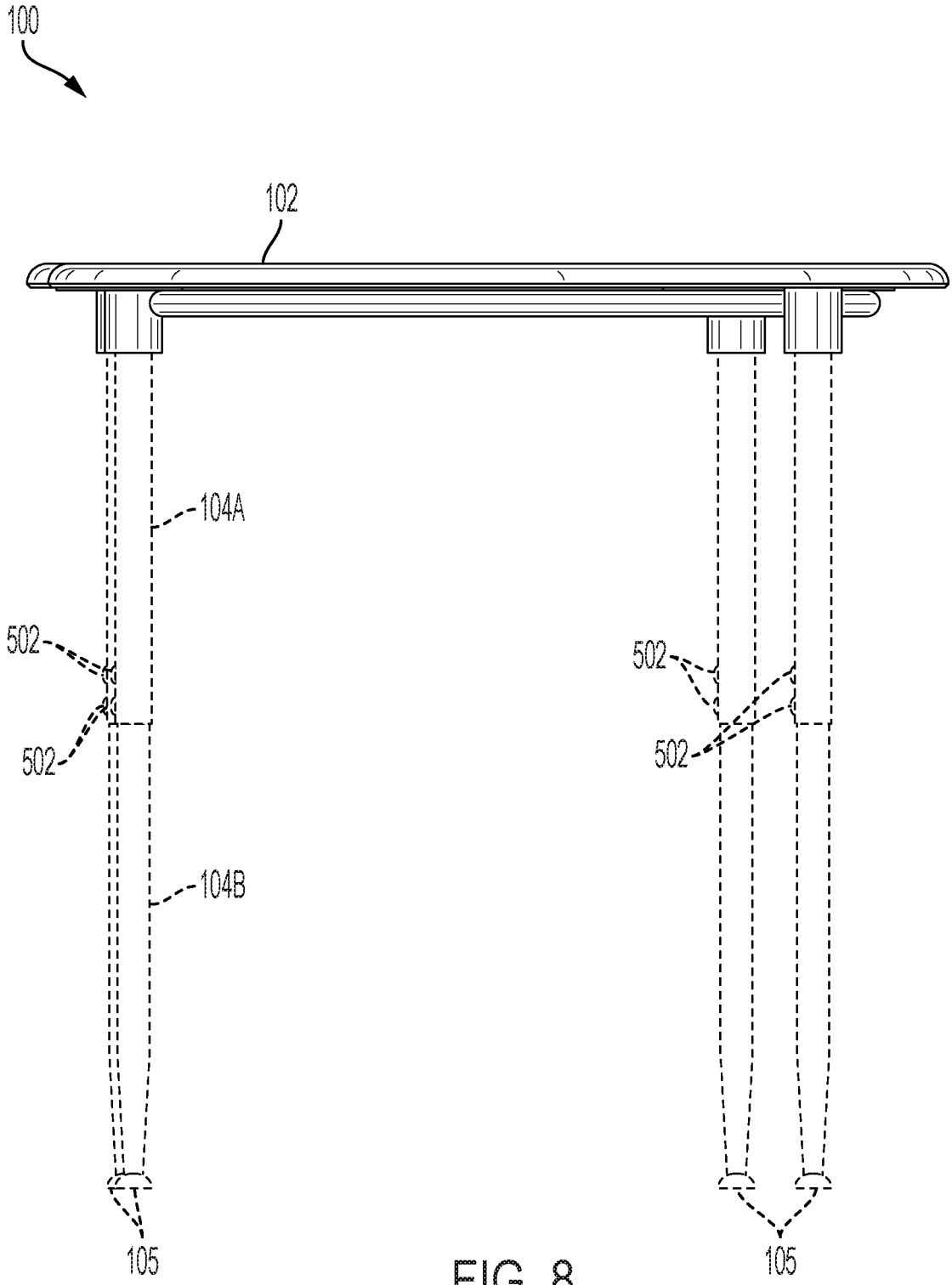
FIG. 8 illustrates another side view of the table system according to the disclosed embodiments.

FIG. 3 depicts top planar surface 202 according to the disclosed embodiments. FIG. 4 depicts bottom planar surface 206 according to the disclosed embodiments. FIGS. 3 and 4 show distinctive features of table surface 102. For example, side surfaces 204 may have a curvilinear shape for at least two portions of the side surfaces. Table surface 202 includes three such portions, but the disclosed embodiments are not limited to three side surfaces having curvilinear shapes. At least one side surface 204 does not have the curvilinear shape of the other side surfaces.

Referring to FIG. 3, table surface 102 has four side surfaces 204. Curvilinear shape 302 may correspond to the longest side surface 204. Linear shape 308 may correspond to the shortest side surface 204. Curvilinear shapes 304 and 306 correspond to side surfaces 204 having a length in between curvilinear shape 302 and linear shape 308. Within the curvilinear shapes, at least one has a concave arc and at least one has a convex arc. These arcs have a radius of curvature R, shown in FIG. 3. The radius of curvature may be substantially equal for each curvilinear surface. Linear shape 308 does not have the radius of curvature R. In some embodiments, linear shape 308 for the shortest side surface 204 is substantially straight.

Side surfaces 204 also meet to form corners 310. As shown in FIGS. 3 and 4, corners 310 are substantially round or curved. The number of corners 310 may correspond to the number of legs 104 or side surfaces 204. In other words, if table system 100 includes five side surfaces 204 and five legs 104, then the number of corners 310 also is five. Corners 310 also may have a radius of curvature proportional to the radius of curvature R for the curvilinear surfaces, except for those corners adjoining linear shape 308.

Referring to FIG. 4, bottom planar surface 206 is shown along with mounting plates 106 and mounting attachments 107. Mounting plates 106 may be attached to bottom planar surface 206 with connectors 402. In some embodiments, connectors 402 are screws, nails, pegs, and the like. Four connectors 402 are shown, but any number may be used. Mounting plates 106 are shown with substantially triangular shapes, but other shapes may be implemented, such as a circular, square, or rectangular shape.

Mounting attachments 107 project from mounting plates 106 to secure legs 104 to table surface 102. Mounting attachments 107 project away from table surface 102. Connection bars 108 also are placed between mounting attachments 107. Each mounting attachment 107 includes apertures 404 to receive an end of a connection bar 108. The apertures, or holes, may be spaced to accommodate the shape of table surface 102. Because of this arrangement, connection bars 108 may be offset from bottom planar surface 206.

Some of the connection bars 108 also have the curvilinear shape of side surfaces 204. In preferred embodiments, the curvilinear shapes of connection bars 108 are substantially the same shape of the curvilinear side surfaces 204. At least one connection bar 108 has substantially the same shape of the linear shaped side surface 204. In other words, at least one connection bar 108 may be substantially straight. Connection bars 108 having a curvilinear shape also have the radius of curvature R of the curvilinear shapes shown as 302, 304, and 306 in FIG. 3.

The curvilinear shapes of side surfaces 204 and connection bars 108 allow for greater support provided by table system 100. The linear side surface allows for placement of table system 100 against a wall, desk, or other surface that is substantially linear. The curved side surfaces, however, allow for comfort of the user while sitting at the table system. The radius of curvature R may be the same for all non-linear side surfaces and connection bars to evenly distribute pressure that is placed upon table surface 102.

FIGS. 5-8 depicts side views of table system 100. In some views, connectors 502 are shown. Connectors 502 may differ from connectors 402 disclosed above. Connectors 502 secure lower leg section 104B to upper leg section 104A. In some embodiments, connectors 502 may be screws, or pins that extend through holes in upper leg section 104A. In other embodiments, several holes may be provided in upper leg section 104A to adjust the height of leg 104.

The disclosed features of table system 100 provide a configurable system to build a table. For example, table surface 102 is provided. Mounting plates 106 are secured at corners 310 of table surface 102. Mounting attachments 107 are placed into mounting plates 106. Connection bars 108 also are configured between mounting attachments 107. Connection bars 108 substantially match the curved or linear shape of the side surfaces 204 of table surface 102.

Legs 104 are placed into mounting attachments 107. Preferably, upper leg sections 104A are placed into the receiving portions of the mounting attachments. Lower leg sections 104B are connected to upper leg section 104A using connectors 502. Thus, table system 100 may be packed in a substantially flat manner without the need for additional space to accommodate legs 104 or other projecting parts. Connection bars 108 also provide additional support for table system 100 and may help distribute a load placed on table surface 102. The curved shapes for side surfaces 204 and connection bars also serves to not apply too much pressure or force against a mounting plate 106 or mounting attachment 107.

Table system 100 may be comprised of various types of materials. For example, table surface 102 may be comprised of wood while legs 104, mounting plates 106, and mounting attachments 107 may be comprised of metal. Connections bars 108 also may be metal to provide additional support without the discomfort of a metal table surface 102. Connections bars 108, however, also may be comprises of wood. The components of table system 100 also may be comprised of plastic.

It will be apparent to those skilled in the art that various modifications to the disclosed golf teaching aid system without departing from the spirit or scope of the invention. Thus, it is intended that the present invention covers the modifications and variations disclosed above provided that these changes come within the scope of the claims and their equivalents.

The invention claimed is:

1. A table system comprising:

a table surface having a top planar surface and a bottom planar surface, wherein a plurality of side surfaces is located between the top planar surface and the bottom planar surface;

a plurality of mounting plates and mounting attachments connected to the table surface on the bottom planar surface at a plurality of corners on the table surface;

a plurality of legs to insert into the plurality of mounting attachments;

a plurality of connection bars coupled to the plurality of mounting attachments, wherein each of the plurality of connection bars is configured between two of the plurality of mounting attachments, wherein the plurality of side surfaces includes a set of curvilinear shaped side surfaces having at least one curvilinear shaped side surface having a concave arc and at least one curvilinear shaped side surface having a convex arc, the concave arc and the convex arc having a substantially equal radius of curvature, a linear shaped side surface that is the shortest side surface of the plurality of side surfaces, wherein the linear shaped side surface is positioned opposite the longest curvilinear shaped side surface having the convex arc, and a plurality of corners formed by the plurality of side surfaces, wherein the plurality of corners have the substantially equal radius of curvature except for those corners adjoining the linear shaped side surface.

2. The table system of claim 1, wherein the plurality of connection bars includes a set of curvilinear shaped connection bars, wherein each curvilinear shaped connection bar is substantially the same shape as the corresponding side surface, and a linear shaped connection bar corresponding to the linear shaped side surface.

3. The table system of claim 2, wherein the set of curvilinear shaped connection bars has at least one curvilinear shaped connection bar having a concave arc and at least one curvilinear shaped connection bar having a convex arc, the concave arc and the convex arc of the set of curvilinear shaped connection bars having the substantially equal radius of curvature of the set of curvilinear shaped side surfaces.

4. The table system of claim 1, wherein each of the plurality of legs includes an upper leg section and a lower leg section, the upper leg section to fit into one of the plurality of mounting attachments.

5. The table system of claim 4, wherein a length of the plurality of legs is adjustable by adjusting the upper leg section and the lower leg sections.

6. The table system of claim 1, further comprising a plurality of pads on the ends of the plurality of legs.

7. A table system comprising:

a table surface including a top planar surface, a bottom planar surface located below the top planar surface, and side surfaces between the top planar surface and the bottom planar surface, the side surfaces comprising at least one side surface having a curvilinear shape with a concave arc, at least one side surface having a curvilinear shape with a convex arc, and a side surface having a substantially linear shape, wherein the substantially linear shaped side surface is shorter in length than the curvilinear shaped side surfaces, wherein the substantially linear shaped side surface is positioned opposite the longest curvilinear shaped side surface having the convex arc;

a plurality of corners to connect the side surfaces, wherein each of the plurality of corners has a rounded shape, wherein the plurality of corners have the substantially equal radius of curvature except for those corners adjoining the linear shaped side surface;

mounting plates and mounting attachments connected to the bottom planar surface at each of the plurality of corners;

connection bars configured between the mounting attachments and corresponding to the side surfaces, each of the connection bars having a shape substantially similar to its corresponding side surface; and legs configured to be inserted into the mounting attachments, wherein the convex arc and the concave arc of the curvilinear shaped side surfaces have a substantially similar radius of curvature.

8. A table comprising:

a table surface having a top planar surface and a bottom planar surface, wherein a plurality of side surfaces is located between the top planar surface and the bottom planar surface;

wherein the plurality of side surfaces includes a set of curvilinear shaped side surfaces having at least one curvilinear shaped side surface having a concave arc and at least one curvilinear shaped side surface having a convex arc, the concave arc and the convex arc having a substantially equal radius of curvature, and a linear shaped side surface that is the shortest side surface of the plurality of side surfaces, wherein the linear shaped side surface is positioned opposite the longest curvilinear shaped side surface having the convex arc; and a plurality of corners formed by the plurality of side surfaces, wherein the plurality of corners have the substantially equal radius of curvature except for those corners adjoining the linear shaped side surface.

9. The table of claim 8, further comprising a plurality of mounting plates and mounting attachments connected to the table surface on the bottom planar surface at a plurality of corners on the table surface.

10. The table of claim 9, further comprising a plurality of connection bars configured between the mounting attachments and corresponding to the side surfaces, each of the connection bars having a shape substantially similar to its corresponding side surface.

11. The table of claim 10, wherein the plurality of connection bars includes a set of curvilinear shaped connection bars, wherein each curvilinear shaped connection bar is substantially the same shape as the corresponding side surface, and a linear shaped connection bar corresponding to the linear shaped side surface.

12. The table of claim 11, wherein the set of curvilinear shaped connection bars has at least one curvilinear shaped connection bar having a concave arc and at least one curvilinear shaped connection bar having a convex arc, the concave arc and the convex arc of the set of curvilinear shaped connection bars having the substantially equal radius of curvature of the set of curvilinear shaped side surfaces.

* * * * *